US006113150A

United States Patent [19]

Kinberg

[11] Patent Number: 6,113,150

[45] Date of Patent: Sep. 5, 2000

[54] LUMINESCENT WRITING DISPLAY DEVICE HAVING PROTECTIVE LAYER

[76] Inventor: Benjamin Kinberg, 425 Riverside Dr., Apt. 5A, New York, N.Y. 10025

[21] Appl. No.: 09/335,251

[22] Filed: Jun. 17, 1999

[51] Int. Cl.[7] ..... B42D 15/00

[52] U.S. Cl. ..... 283/94; 283/109; 283/45

[58] Field of Search ..... 283/94, 107, 109, 283/61, 62; 281/38; 402/29; 434/410

[56] References Cited

U.S. PATENT DOCUMENTS

| | | | |
|---|---|---|---|
| 4,927,748 | 5/1990 | Kinberg | 434/410 |
| 4,988,301 | 1/1991 | Kinberg | 434/410 |

FOREIGN PATENT DOCUMENTS

| | | | |
|---|---|---|---|
| WO 90/03277 | 4/1990 | WIPO | 283/94 |

*Primary Examiner*—Willmon Fridie, Jr.

*Attorney, Agent, or Firm*—Grimes & Battersby, LLP

[57] ABSTRACT

A writing and display device for producing luminescent images upon application of pressure thereon which can be readily erased and repeatedly used having a protective layer to prevent damage to the writing surface thereof. The device includes a backing member with a smooth surface over which a translucent or transparent sheet containing a luminescent dye or pigment and an opaque pliable plastic sheet are disposed. At least one of the sheets is formed of a pliable plastic with its interface surface tending to adhere to the interfacing surface of the other sheet when a pressure is applied thereto to produce luminescent images. A pliable, transparent protective sheet is disposed adjacent to and coextensive with the translucent or transparent luminescent sheet. Upon application of pressure onto the protective sheet, which pressure is transmitted to the luminescent sheet by virtue of the pliability of the protective sheet, the interfacing surfaces adhere to each other to thereby produce a luminescent image.

9 Claims, 1 Drawing Sheet

LUMINESCENT WRITING DISPLAY DEVICE HAVING PROTECTIVE LAYER

BACKGROUND OF THE INVENTION

1. Field of the Invention

The present invention relates to a writing and display device for producing semipermanent luminescent images having a protective layer.

2. Description of the Prior Art

Writing and display devices having a translucent or transparent sheet containing luminescent dye and a complementary opaque pliable plastic sheet disposed adjacent to, and coextensive with, the translucent or transparent sheet are well known. With such conventional writing and display devices, upon application of pressure by means of, for example a stylus or the like, the two sheets tend to adhere to one another along the points of applied pressure to produce a luminescent image. The translucent or transparent sheet as well as the complementary opaque pliable plastic sheet are usually made of plastic material, such as vinyl. Writing and display devices of this type are disclosed in U.S. Pat. No. 3,761,343 which issued to Kinberg on Sep. 25, 1973 and U.S. Pat. No. 4,011,665, which issued to Port on Mar. 15, 1977.

Improvements have been made to such writing and display devices and are disclosed in U.S. Pat. No. 4,801,266 which issued to Kinberg on Jan. 31, 1989, U.S. Pat. No. 4,927,748 which issued to Kinberg on May 22, 1990 and U.S. Pat. No. 4,988,301 which issued to Kinberg on Jan. 29, 1991. However, a problem with all of the prior art writing and display devices is the damage that is often caused by the stylus to the surface of the writing and display device. In none of the prior art is a means for protecting the surface of the writing and display device from damage from the stylus.

As will be appreciated, none of these prior patents even address the problem faced by applicant let alone offer the solutions proposed herein.

SUMMARY OF THE INVENTION

It is thus a general object of the present invention to provide an improved writing and display device having a protective layer.

This object and others which will become apparent hereinafter are attained in accordance with the present invention by providing a transparent protective layer disposed contiguously with the luminescent sheet and the rigid backing member. This protective sheet may suitably be made of a clear acetate or other transparent material of an adequate thickness to prevent puncture by the stylus and prevent damage to the luminescent sheet by said stylus.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
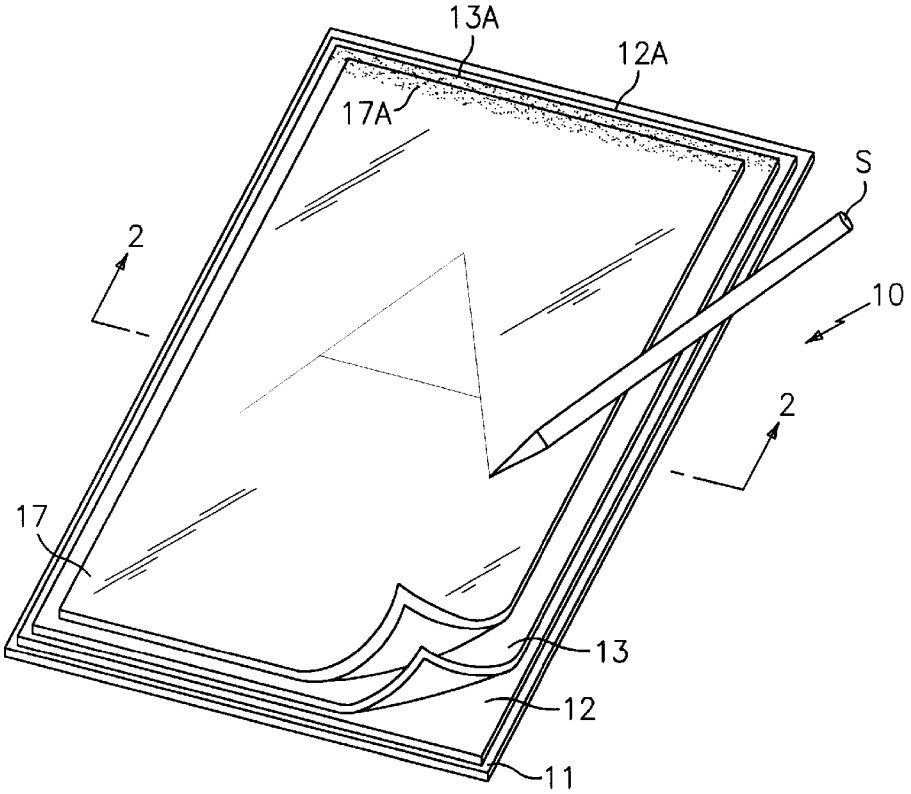
FIG. 1 is a perspective view of one embodiment of a writing and display device in accordance with the present invention.

Referring now to the drawings, and in particular to FIG. 1, there is shown a perspective view of one embodiment of a writing and display device in accordance with the present invention and generally designated by reference numeral 10. It will be readily recognized that the writing and display device is shown only by way of example and may take various forms to resemble for example a writing tablet, pad or slate. The writing and display device 10 includes a backing member 11 which can be made of any suitable rigid material such as cardboard, nonpliable plastic, metal or the like. Supported on or secured to the backing member 11 and rendered substantially co-extensive thereto is a relatively smooth pliable sheet of an opaque pliable plastic sheet 12 preferably having a white or "milk color" opacity. The opaque pliable plastic sheet 12 may be formed of a pliable vinyl type plastic having a smooth, wetable type surface appearance.

Disposed adjacent to and coextensive with the opaque pliable plastic sheet 12 in interfacing relationship is a transparent or translucent pliable sheet 13 of plastic material such as vinyl which has a smooth, wettable type surface appearance. Dispersed through the plastic sheet 13 is a luminescent or fluorescent tinting material, e.g. a dye or pigment to result in a transparent or translucent tinted sheet. It will be appreciated that throughout the description the terms luminescent, fluorescent, iridescent, phosphorescent and glowing are considered to be synonymous in describing the nature of the dye or pigment and the effect or appearance of the image displayed. Essentially, the nature of the dye or pigment dispersed throughout the plastic sheet 13 is such so as to produce a glowing or luminescent image when applying a pressure thereto.

The plastic sheet 13 is suitably formulated with a primary plasticizer, preferably with a primary low volatile plasticizer in order to prevent the luminescent dye or pigment from migrating onto the underlying opaque pliable plastic sheet 12. Suitable plasticizers for formulating the luminescent plastic sheet 13 may include diisodecyl phthalate, trialkyl trimellitates, e.g. trioctyl trimellitate, epoxidized soya oil or other epoxidized fatty esters, polymeric plasticizers such as adipic acid or azelaic acid polyesters of molecular weight 850–6000 made from dicarboxylic acids such as adipic or azelaic acid, e.g. the PARAPLEX plasticizers made by C. P. Hall Co. of Chicago, Ill.

Migration can be further prohibited or minimized by dispersing fluorescent pigments rather than dyes throughout the plastic sheet 13. While pigments, in contrast to dyes, are solid particles, they are so finely divided that they can be readily dispersed to form a transparent colored or tinted plastic film or sheet that is extremely suitable for application as a luminescent or fluorescent writing and display device.

Disposed adjacent to plastic sheet 13 is a pliable protective sheet 17 of a transparent material such as clear acetate or other plastic. The minimum thickness of protective sheet 17 depends upon the material of which it is composed such that a stylus such as a pen or pencil will neither puncture nor damage protective sheet 17, nor will the depression of such stylus in protective sheet 17 cause any damage to plastic sheet 13. However, protective sheet 17 must not be so thick that pressure applied by a stylus on the surface of protective sheet 17 will not be transmitted through protective sheet 17 to the plastic sheet 13 beneath it.

Figure 3:
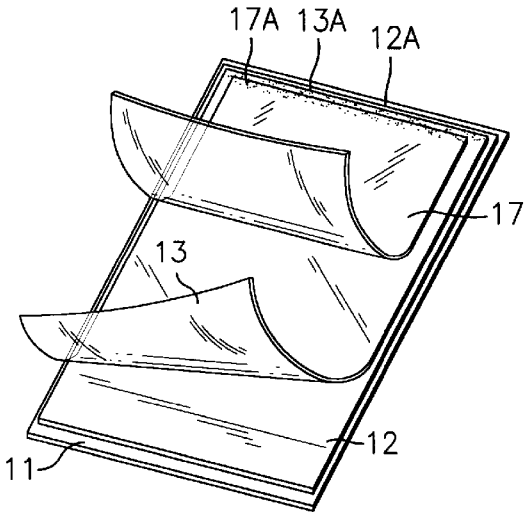
FIG. 3 is a perspective view of the writing and display device of FIG. 1, illustrating the manner as to how a formed image may be readily erased.

The plastic sheet 13 and protective sheet 17 and opaque pliable plastic sheet 12 are suitably secured in overlying position relative to the backing member 11 along one edge thereof, e.g. along edge 12A, 13A and 17A, by suitable means to form a hinging connection between each layer. This may be effected by adhesively securing the edge portion 12A of opaque pliable plastic sheet 12 to the contiguous edge 11A of the backing member 11 and adhesively securing the edge portion 13A of plastic sheet 13 to the contiguous edge 12A of the opaque pliable plastic sheet 12 and adhesively securing the edge portion 17A of the protective sheet 17 to the contiguous edge 13A of the plastic sheet 13, by heat sealing, by a binding hinge strip of material, by tacking or any other suitable hinging construction. As shown in FIG. 3, the hinging effect renders the protective sheet 17, plastic sheet 13, opaque pliable plastic sheet 12 and the backing member 11 readily separable by lifting the plastic sheet 13 from the backing member 11. Alternatively, the protective sheet 17 and plastic sheet 13 may be joined to create one pliable sheet (not shown).

Figure 2:
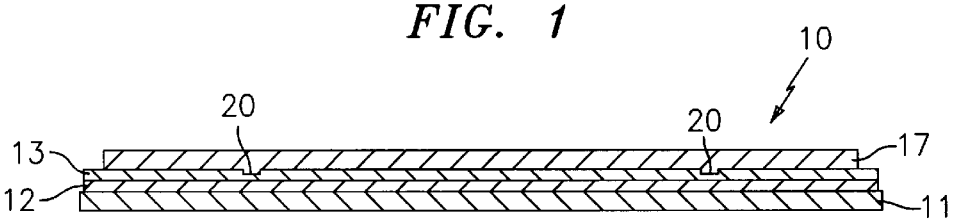
FIG. 2 is a cross sectional view taken along the line 2—2 in FIG. 1.

In operation, applying pressure to protective sheet 17 by a stylus S, results in applied pressure to the translucent or transparent plastic sheet 13, causing the plastic sheet 13 to adhere to the opaque pliable plastic sheet 12 at the points of applied pressure by forming corresponding depressions 20 as indicated in FIG. 2 so that light reflecting at such depressions creates a luminescent image. As the interfacing surfaces of the plastic sheet 13 and the opaque pliable plastic sheet 12 have a smooth, wet-like appearance, they tend to remain adhered or cohered to one another along the depressions 20 of applied pressure to sustain the luminescent image until the intimate contact between the plastic sheet 13 and opaque pliable plastic sheet 12 is broken. This can be readily attained by lifting the plastic sheet 13 away from the opaque pliable plastic sheet 12 as shown in FIG. 3.

It will be appreciated that the image may also be erased by other suitable separating means which may be disposed between the plastic sheet 13 and the opaque pliable plastic sheet 12 and attain effective separation of the plastic sheet 13 from the opaque pliable plastic sheet 12 along the points of applied pressure.

While the invention has been illustrated and described as embodied in a luminescent writing and display device, it is not intended to be limited to the details shown since various modifications and structural changes may be made without departing in any way from the spirit of the present invention. forth in the appended claims.

Wherefore, I claim:

1. A writing and display device for producing a semi-permanent luminescent image upon the application of a writing pressure thereon comprising:

a rigid backing member;

an opaque sheet disposed contiguous to said rigid backing member;

a transparent plastic sheet disposed contiguous to said opaque sheet to be in direct interfacing relationship therewith, said transparent plastic sheet containing a tinting material integrally dispersed throughout, said transparent plastic sheet further being pliable so that upon the application of a pressure thereon, the respective surfaces of said transparent sheet and said opaque sheet are urged into intimate contact at the points of applied pressure to form a luminescent image along the points of applied pressure that will be retained thereon so long as said transparent tinted sheet and said opaque sheet are adhered to one another along the points of applied pressure; and a transparent cover sheet disposed adjacent to said transparent plastic sheet said transparent cover sheet transmitting said writing pressure to said transparent plastic sheet so as to allow uninterrupted writing.

2. The writing and display device of claim 1, wherein said rigid backing member is formed of an inexpensive cardboard material.

3. The writing and display device of claim 1, wherein said opaque sheet is formed of a pliable vinyl type plastic having a smooth, wetable type surface appearance.

4. The writing and display device of claim 1, wherein said tinting material comprises a luminescent pigment.

5. The writing and display device of claim 1, wherein the surfaces of said sheets have exposed smooth surfaces for direct contact at the interface thereof.

6. The writing and display device of claim 1, wherein said transparent sheet, said opaque sheet and said transparent cover sheet are substantially co-extensive in size.

7. The writing and display device of claim 1, wherein said transparent sheet is readily separable from said opaque sheet for effecting the erasure of any image formed thereon.

8. The writing and display device of claim 1, wherein said transparent cover sheet is composed of clear acetate.

9. A writing and display device for producing a semi-permanent luminescent image upon application of a writing pressure thereon comprising:

a rigid backing member;

an opaque sheet having smooth exposed surfaces disposed contiguous to said rigid backing member;

a transparent plastic sheet having smooth exposed surfaces disposed contiguous to said opaque sheet to be in direct interfacing relationship therewith, said transparent plastic sheet containing a luminescent pigment tinting material integrally dispersed throughout, said transparent plastic sheet further being pliable so that upon the application of a pressure thereon, the respective surfaces of said transparent sheet and said opaque sheet are urged into intimate contact at the points of applied pressure to form a luminescent image along the points of applied pressure that will be retained thereon so long as said transparent tinted sheet and said opaque sheet are adhered to one another along the points of applied pressure, said transparent plastic sheet being substantially co-extensive in size with said opaque sheet, said transparent plastic sheet further being readily separable from said opaque sheet for effecting the erasure of any image formed thereon; and a transparent cover sheet having smooth exposed surfaces disposed adjacent to said transparent plastic sheet, said transparent cover sheet being substantially co-extensive in size with said transparent plastic sheet said transparent cover sheet transmitting said writing pressure to said transparent plastic sheet so as to allow uninterrupted writing.

* * * * *